US011233306B1

(12) United States Patent
Dressel et al.

(10) Patent No.: US 11,233,306 B1
(45) Date of Patent: Jan. 25, 2022

(54) DUO-QUAD WIDEBAND WAVEGUIDE COMBINER/MODE-CONVERTER TRANSFORMING TWO RECTANGULAR WAVEGUIDES IN THE $TE_{10}$ RECTANGULAR MODE TO A SINGLE CIRCULAR WAVEGUIDE OUTPUT IN THE $TE_{01}$ MODE

(71) Applicant: Raytheon Company, Waltham, MA (US)

(72) Inventors: Earl M. Dressel, Albuquerque, NM (US); John F. Aurand, Edgewood, NM (US)

(73) Assignee: RAYTHEON COMPANY, Waltham, MA (US)

( * ) Notice: Subject to any disclaimer, the term of this patent is extended or adjusted under 35 U.S.C. 154(b) by 0 days.

(21) Appl. No.: 16/891,637

(22) Filed: Jun. 3, 2020

Related U.S. Application Data

(60) Provisional application No. 62/946,459, filed on Dec. 11, 2019.

(51) Int. Cl.
*H01P 5/08* (2006.01)
*H01P 1/213* (2006.01)
*H01P 5/18* (2006.01)

(52) U.S. Cl.
CPC ..... *H01P 5/082* (2013.01); *H01P 1/2138* (2013.01); *H01P 5/181* (2013.01)

(58) Field of Classification Search
CPC ..... H01P 5/082; H01P 5/181; H01P 1/2138
USPC ..... 333/21 R
See application file for complete search history.

(56) References Cited

U.S. PATENT DOCUMENTS 2,825,031 A * 2/1958 Parisi ..... H01P 1/163 333/21 A
3,230,484 A * 1/1966 Lipetz ..... H01P 1/163 333/21 R
4,973,924 A * 11/1990 Bergero ..... H01J 25/025 333/137
7,323,949 B2 * 1/2008 Forslund ..... H01P 1/16 333/21 R
7,432,780 B2 * 10/2008 Chan ..... H01P 1/161 333/127

* cited by examiner

*Primary Examiner* — Robert J Pascal
*Assistant Examiner* — Kimberly E Glenn
(74) *Attorney, Agent, or Firm* — Daly, Crowley, Mofford & Durkee, LLP

(57) ABSTRACT

A duo-quad wideband wave guide combiner includes a circular waveguide having a center axis with a cross section with four quadrants; and two waveguides, each waveguide being bifurcated at an input to the wave guide combiner by a thin septum to split each of the two waveguide into two bifurcated waveguides, each of the bifurcated waveguides rotating to a respective one of the four quadrants about the center axis of the circular waveguide with converging walls terminating when a composite cross section becomes circular.

12 Claims, 9 Drawing Sheets

DUO-QUAD WIDEBAND WAVEGUIDE COMBINER/MODE-CONVERTER TRANSFORMING TWO RECTANGULAR WAVEGUIDES IN THE $TE_{10}$ RECTANGULAR MODE TO A SINGLE CIRCULAR WAVEGUIDE OUTPUT IN THE $TE_{01}$ MODE

CROSS-REFERENCE TO RELATED APPLICATIONS

This application claims priority from U.S. Provisional application Ser. No. 62/946,459 filed on Dec. 11, 2019, which is incorporated herein by reference.

STATEMENT REGARDING FEDERALLY SPONSORED RESEARCH

Not Applicable.

FIELD

This disclosure relates generally to microwave devices, and, more particularly, to a high power microwave combiner.

BACKGROUND

Efficient extraction of radio frequency (RF) power from microwave tube sources is a key element of high power microwave (HPM) technology. A natural way to harvest maximal RF energy from a high-power pulsed magnetron RF source is by radial extraction via rectangular waveguide from every other resonator. However, this extraction approach presents the subsequent problem of combining RF power in separate waveguides into a single feed suitable for a directive antenna. Also, pulsed operation of the high-power magnetron introduces a time interval over which plasma oscillations are somewhat incoherent before settling into the stable $\pi$ mode. During this time interval the frequency varies from the eventual resonant frequency, and it is critical that reflected waves at these spurious frequencies not disrupt formation of the $\pi$ mode, or else the magnetron will not reliably form a HPM pulse. A second objective of the HPM pulsed magnetron is to be tunable over a finite frequency band. Consequently, robust RF design of the HPM system requires that downstream waveguide elements maintain a low reflection coefficient over an adequately broad frequency band.

SUMMARY

The present disclosure teaches a duo-quad wideband wave guide combiner comprising: a circular waveguide having a center axis with a cross section with four quadrants; and two waveguides, each waveguide being bifurcated at an input to the wave guide combiner by a thin septum to split each of the two waveguide into two bifurcated waveguides, each of the bifurcated waveguides rotating to a respective one of the four quadrants about the center axis of the circular waveguide with converging walls terminating when a composite cross section becomes circular. The duo-quad wideband wave guide combiner may include one or more of the following features to include: wherein each one of the bifurcated waveguides accommodates a $TE_{10}$ rectangular mode signal and transitions from a rectangular cross section to a cross section resembling a pie slice spanning one quadrant of a composite circular cross section; successive machined layers of metal stacked upon each other with each machined layer shaped accordingly to provide the transition from a rectangular cross section to a cross section resembling a pie slice spanning one quadrant of a composite circular cross section; successive machined layers of metal stacked upon each other with each machined layer shaped accordingly to provide the transition for each one of the bifurcated waveguides from a rectangular cross section to a cross section resembling a pie slice spanning one quadrant of a composite circular cross section to provide a composite circular cross section; or wherein each one of the bifurcated waveguides once transitioned to a cross section resembling a pie slice spanning one quadrant of a composite circular cross section to provide a composite circular cross section terminates a thin septum between adjacent pie slice cross sections.

The present disclosure also teaches a power combiner for combining radio frequency signals from two inputs into a combined output signal at an output having a $TE_{01}$ circular mode comprising: a first rectangular waveguide having a $TE_{10}$ rectangular mode, the first rectangular waveguide having a thin septum to bifurcate the first rectangular waveguide into two bifurcated waveguides, each one of the two bifurcated waveguides of the first rectangular waveguide transitions from a rectangular cross section to a cross section resembling a pie slice spanning one quadrant of a composite circular cross section; a second rectangular waveguide having a $TE_{10}$ rectangular mode, the second rectangular waveguide having a thin septum to bifurcate the second rectangular waveguide into two bifurcated waveguides, each one of the two bifurcated waveguides of the second rectangular waveguide transitions from a rectangular cross section to a cross section resembling a pie slice spanning one quadrant of a composite circular cross section; and a circular waveguide having $TE_{01}$ circular mode, the circular waveguide disposed at converging walls of each one of the quadrants of the composite circular cross section which form a thin septa between each one of the quadrants. The power combiner may include one or more of the following features to include: wherein each one of the thin septa terminates at the circular waveguide; wherein each one of the bifurcated waveguides rotates to a respective quadrant about the center axis of the circular output and transitions from a rectangular cross-section to a cross-section resembling a pie slice spanning one quadrant of the composite circular cross section of circular waveguide; successive machined layers of metal stacked upon each other with each machined layer shaped accordingly to provide the transition from a rectangular cross section to a cross section resembling a pie slice spanning one quadrant of a composite circular cross section; or a metallic plate with the successive machined layers of metal stacked upon each other stacked on the metallic plate ending with a metal ring (flange) and held together with metal rods.

The present disclosure also teaches a method of providing a power combiner for combining two $TE_{10}$ rectangular mode microwave signals into a combined output $TE_{01}$ circular mode microwave signal comprising: providing a metallic plate having a first rectangular opening and a second rectangular opening, each opening accommodating a rectangular waveguide as an input to the power combiner, the first rectangular opening bifurcated by a first thin septum to split the first rectangular waveguide into a first bifurcated waveguide and a second bifurcated waveguide, the second rectangular opening bifurcated by a second thin septum to split the second rectangular waveguide into a third bifurcated waveguide and a fourth bifurcated waveguide; providing a first metallic layer having a first side and a second side with four openings, each of the four openings on the first side mating with a respective bifurcated waveguide in the metallic plate, each of the four opening partially rotates to a respective quadrant about a center axis of a circular output and transitions from a rectangular cross-section to a cross-section resembling a pie slice spanning one quadrant of a composite circular cross section of circular waveguide; providing a second metallic layer having a first side and a second side with four openings, each of the four openings on the first side mating with a respective opening in the second side of the first metallic layer, each of the four opening partially rotates to a respective quadrant about a center axis of a circular output and transitions from a rectangular cross-section to a cross-section resembling a pie slice spanning one quadrant of a composite circular cross section of circular waveguide; providing successive layers having a first side and a second side with four openings, each of the four openings on the first side mating with a respective opening in the second side of an adjacent metallic layer, each of the four opening partially rotates to a respective quadrant about a center axis of a circular output until a transition from a rectangular cross-section to a cross-section resembling a pie slice spanning one quadrant of a composite circular cross section of circular waveguide is completed; and providing a ring with an aperture disposed adjacent the successive layer having a completed composite circular cross section, the aperture sized to match the circular cross section in the successive layer and providing the output of the power combiner. The method may also include the feature wherein the providing successive layers comprises: ensuring transitioning geometry of the layers are disposed so all surfaces have a continuous with no discontinuities in the direction of wave propagation to minimize reflection and the waveguide preserves the wave impedance of the rectangular waveguide throughout the transition. It should be appreciated other methods of fabricating a power combiner as described herein may be employed.

BRIEF DESCRIPTION OF THE DRAWINGS

The foregoing features may be more fully understood from the following description of the drawings. The drawings aid in explaining and understanding the disclosed technology. Since it is often impractical or impossible to illustrate and describe every possible embodiment, the provided figures depict one or more illustrative embodiments. Accordingly, the figures are not intended to limit the scope of the broad concepts, systems and techniques described herein. Like numbers in the figures denote like elements.

DETAILED DESCRIPTION

The features and other details of the disclosure will now be more particularly described. It will be understood that any specific embodiments described herein are shown by way of illustration and not as limitations of the concepts, systems and techniques described herein. The principal features of this disclosure can be employed in various embodiments without departing from the scope of the concepts sought to be protected.

Figure 1:
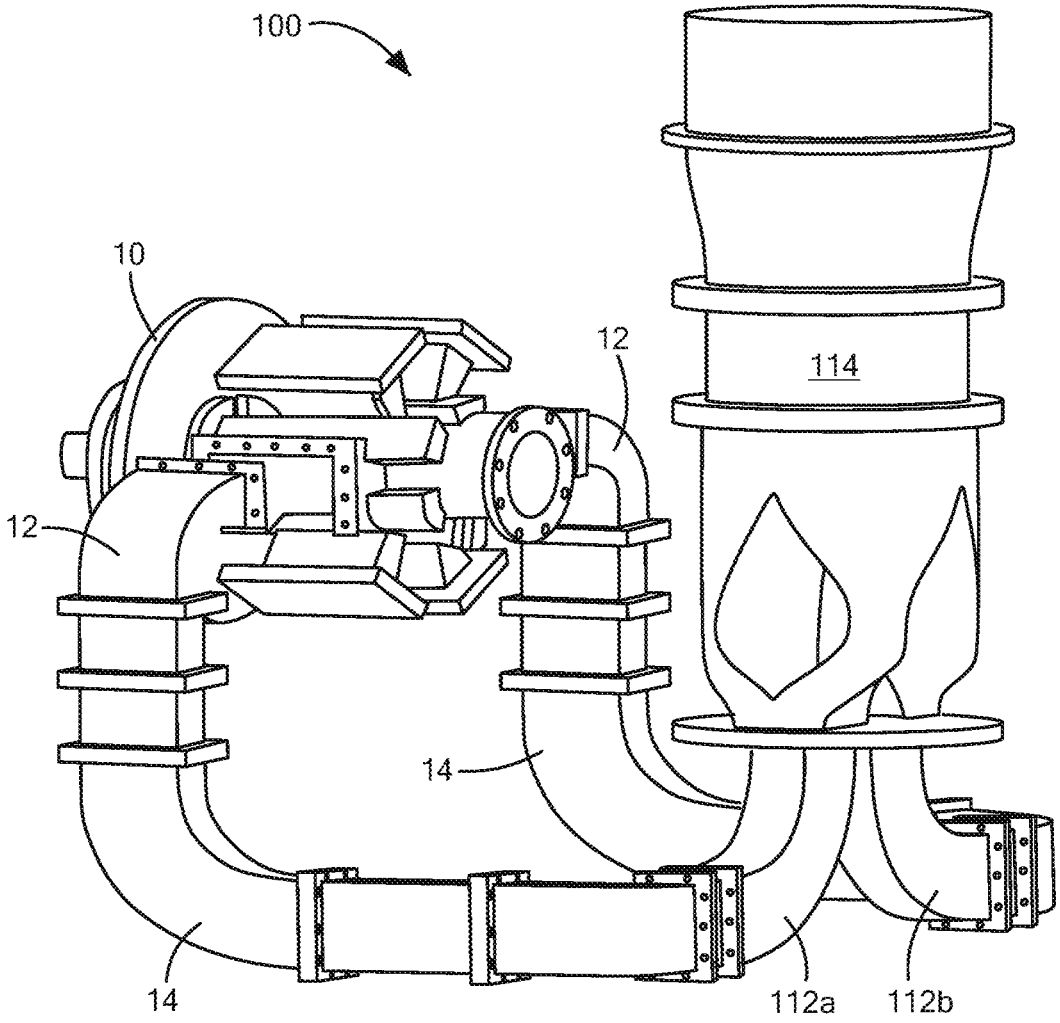
FIG. 1 shows a duo-quad wideband waveguide combiner/mode-converter transforming two rectangular waveguides in the $TE_{10}$ rectangular mode to a single circular waveguide output in the $TE_{01}$ mode.

Referring now to FIG. 1, a duo-quad wideband waveguide combiner/mode-converter 100 (herein also referred to as duo-quad converter 100, duo-quad combiner 100, or combiner 100) transforming two rectangular waveguides in the $TE_{10}$ rectangular mode to a single circular waveguide output in the $TE_{01}$ mode is shown. The disclosure teaches methods and apparatus for combining two rectangular waveguides, each propagating the lowest-order $TE_{10}$ rectangular mode with opposite phase at a common frequency and equal power, into a circular waveguide propagating the axisymmetric $TE_{01}$ circular mode with high mode purity and low reflection. Reciprocity requires that the inverse also applies hence the embodiment will distribute an incident high-purity $TE_{01}$ circular mode in hollow circular waveguide into two rectangular waveguides with low reflection, each propagating the $TE_{10}$ rectangular mode with opposite phase at a common frequency and with equipartition of power. The embodiment is wideband, operating over a 5-10% bandwidth without substantial degradation in performance, and can handle extremely high power, making it suitable for High-Power Microwave (HPM) applications.

The purpose of this disclosure is to combine two radially extracting rectangular waveguides of a pulsed magnetron, both with identical phase and power, into a single waveguide with a well-defined mode of propagation, with very low reflection over a reasonably large frequency band. The output waveguide mode, the $TE_{01}$ circular mode, is particularly useful as the ideal feed for downstream antenna components and contributes to an ensemble system.

A known high power magnetron power source for radio frequency (RF) energy is described in U.S. Pat. No. 9,805,901 B2 issued on Oct. 31, 2017, having the same assignee as the present invention and incorporated herein by reference. As described therein, a magnetron assembly to provide a high power magnetron power source 10 includes a compact magnetic field generator for high-power magnetrons, a high-power magnetron (internal within the magnetron assembly), and multiple output waveguides. One or more wedge shaped output waveguides are coupled to a compact magnetic field generator. Each output waveguide fits between two annular wedge magnets, and each waveguide is mechanically coupled to an RF extraction waveguide or to a termination plate. In the present disclosure, the magnetron assembly includes two extraction waveguides 12.

The combiner 100 includes two input waveguides 112*a*, 112*b* and a circular waveguide 114 to provide an output having a $TE_{01}$ circular mode as to be described in more detail below.

R.F. energy exiting extraction waveguides 12 follows the path defined by the waveguides 14, respectively. Each waveguide 14 branch away from a respective extraction waveguide 12 and connect to a respective input wave guide 112*a*, 112*b* (collectively referred to as waveguide 112) of the combiner 100. Waveguides 14 are well known in the art and are shaped to accommodate the geometry required to connect to the respective input waveguide 112*a*, 112*b* as shown. Depending upon the proximity of the input waveguide 112 to the extraction waveguide 12 alternative embodiments could be used for connecting the extraction waveguide 12 to the input waveguide 112.

Figure 2A:
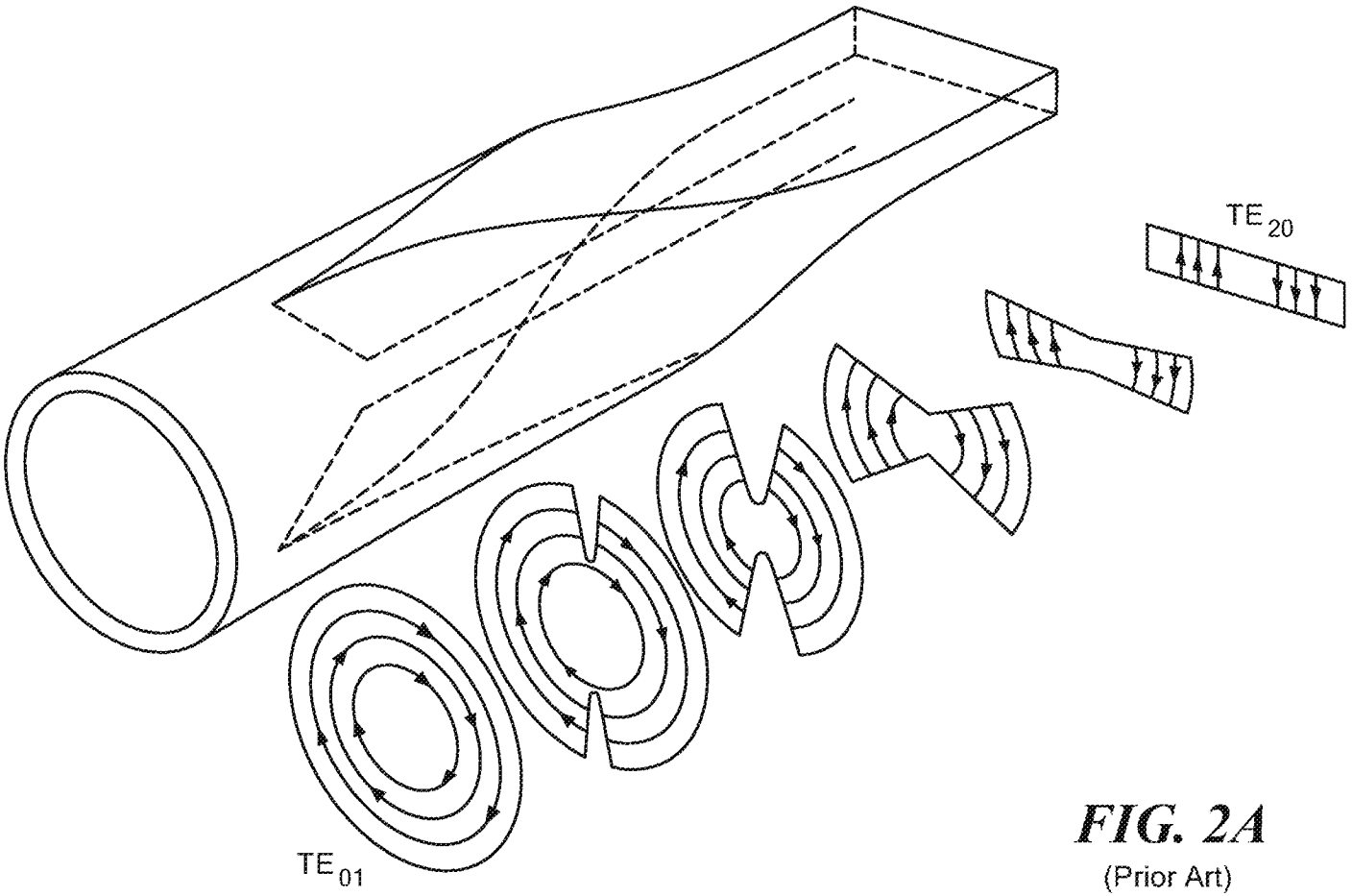
FIG. 2A (Prior Art)
FIG. 2A shows a duo waveguide transition concept.
Figure 2B:
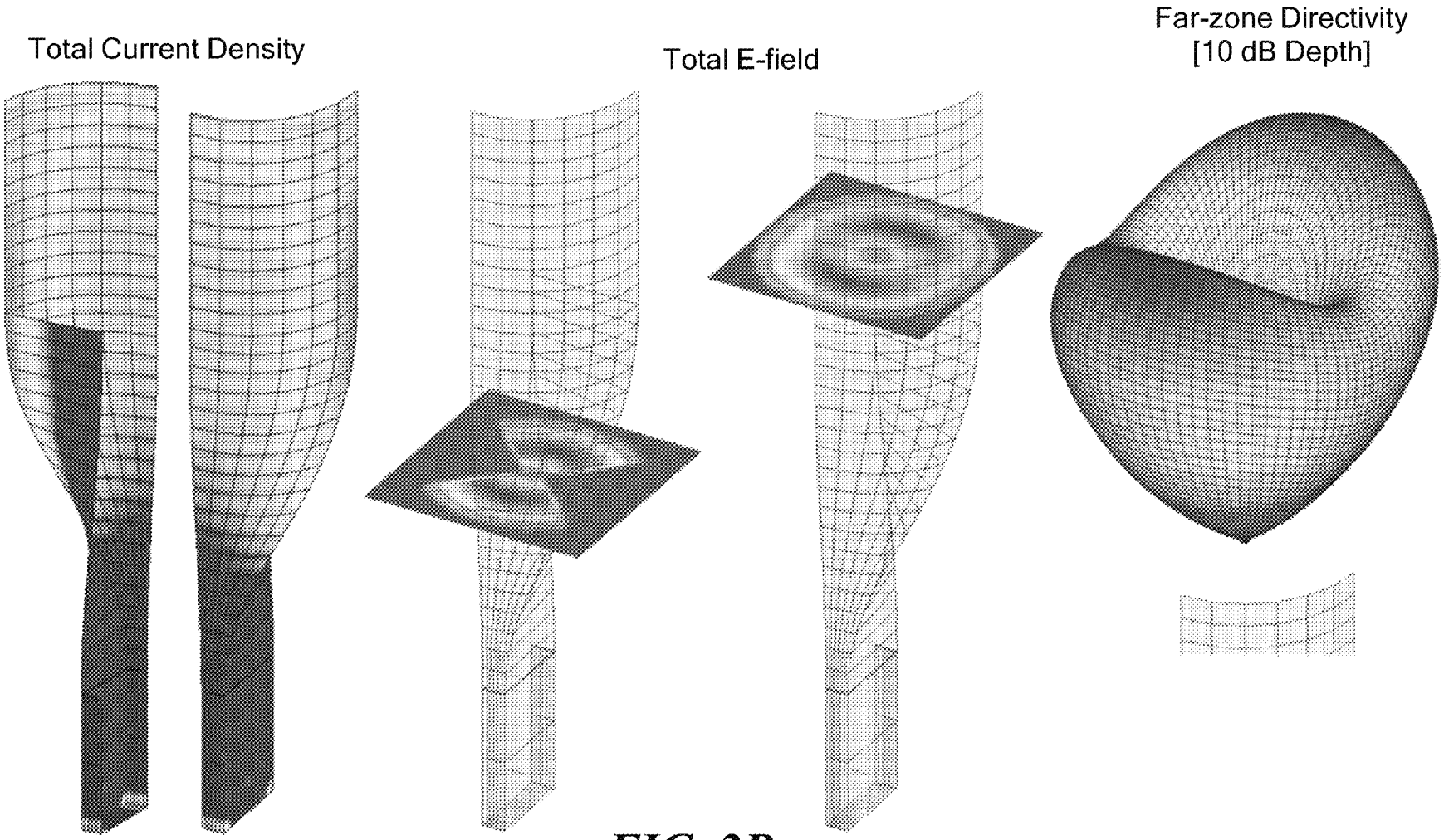
FIG. 2B (Prior Art)
FIG. 2B shows WIPL-D simulations of a slow-taper duo waveguide transition.

Initially, models of a strictly duo waveguide combiner were developed based on a proposed RADLAB concept from the 1940s shown in FIG. 2A' However, detailed electromagnetic (EM) simulations (technology not available to the RADLAB inventor) of the RADLAB-proposed duo waveguide transition demonstrated that azimuthally "stretching" the modal EM fields by 180° on each side of the vertical symmetry plane (FIG. 2A) cannot achieve high mode purity in the output $TE_{01}$ circular mode, regardless of how slow the taper at every stage. Simulation visualizations of a slow taper duo-transition model are shown in FIG. 2B. FIG. 2A shows the duo waveguide transition concept proposed by the RADLAB that does not work well. FIG. 2B shows the WIPL-D simulations of a slow-taper (RADLAB-proposed) duo waveguide transition demonstrating unacceptably poor mode purity in the desired output $TE_{01}$ circular mode.

The duo-quad wideband waveguide combiner/mode-converter 100 as shown in FIG. 1 overcomes the deficiencies of the RADLAB design while providing the means to minimize the axial length without degrading mode purity or bandwidth and without increasing the reflection coefficient.

The duo-quad combiner 100 transforms the $TE_{10}$ rectangular mode of the two rectangular waveguides 112*a*, 112*b* into the $TE_{01}$ circular mode propagating in a single waveguide 114. RF power is extracted from the magnetron 10 into two radial rectangular waveguides 12 on opposite sides of the magnetron axis, with opposite phase and identical power, as shown in FIG. 1. In the two-port extraction approach, equal lengths of standard rectangular waveguide 14 feed the two input ports 112*a*, 112*b* of the duo-quad combiner 100 with opposite phase. Referring now also to FIGS. 1A and 3A, upon entry in the duo-quad combiner 100, each rectangular waveguide input is bifurcated by a thin septum 116. The septum 116 then splits each waveguide into two waveguides, hence waveguide 112*a* splits into waveguides 122*a*, 122*b* and waveguide 112*b* splits into waveguides 122*c*, 122*d*, each of which rotates to its own quadrant about the center axis of the circular output and transitions from a rectangular cross-section to a cross-section resembling a pie slice spanning one quadrant of the composite circular cross section. The converging walls of the separate waveguides merge to form thin septa that abruptly terminate when the composite cross section becomes circular. FIG. 1 shows a two-port extraction from a HPM pulsed magnetron 10 feeding an embodiment of the duo-quad wideband waveguide combiner/mode-converter 100.

FIG. 1A visualizes the duo-quad converter 100. As can be seen, the septum 116 splits each waveguide into two waveguides, hence waveguide 112*a* splits into waveguides 122*a*, 122*b* and waveguide 112*b* splits into waveguides 122*c*, 122*d*. Waveguide 122*a* rotates to its own quadrant about the center axis of the circular output and transitions from a rectangular cross-section to a cross-section resembling a pie slice spanning one quadrant of the composite circular cross section of circular waveguide 114. In a similar manner, waveguide 122*b*, waveguide 122*c* and waveguide 122*d*, each rotates to its own quadrant about the center axis of the circular output and transitions from a rectangular cross-section to a cross-section resembling a pie slice spanning one quadrant of the composite circular cross section of circular waveguide 114.

Figure 1B:
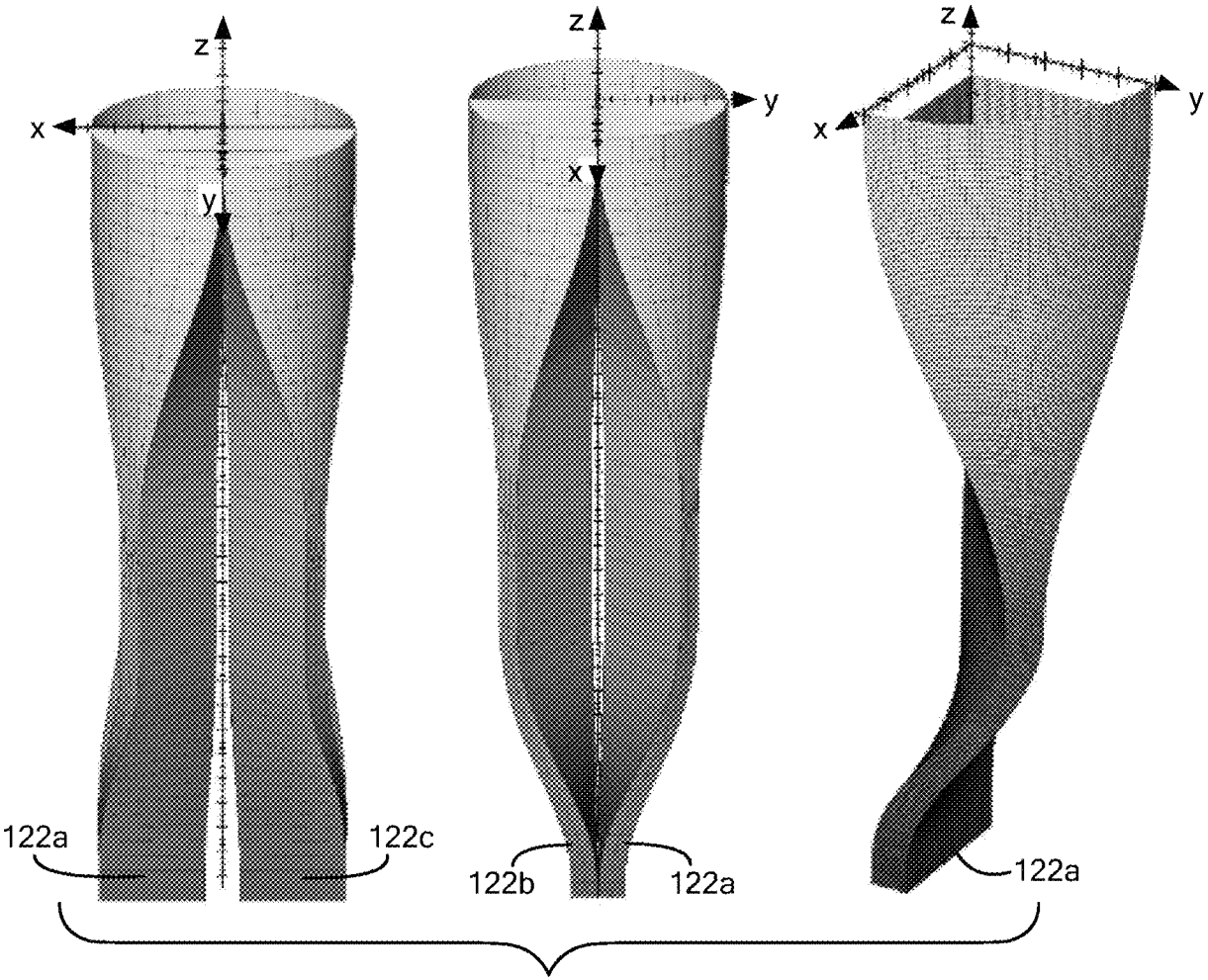
FIG. 1B is a sketch to visualize views of portions the duo-quad converter.
Figure 1A:
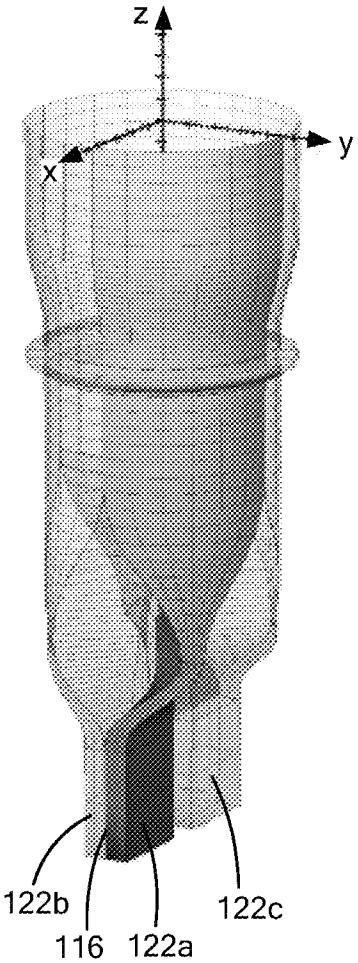
FIG. 1A is a sketch to visualize the duo-quad converter.

FIG. 1B visualizes various views of portions the duo-quad converter 100 showing the transition and shape of each respective wave guide as it transitions from a rectangular waveguide to one quadrant of the composite circular cross section.

Figure 2C:
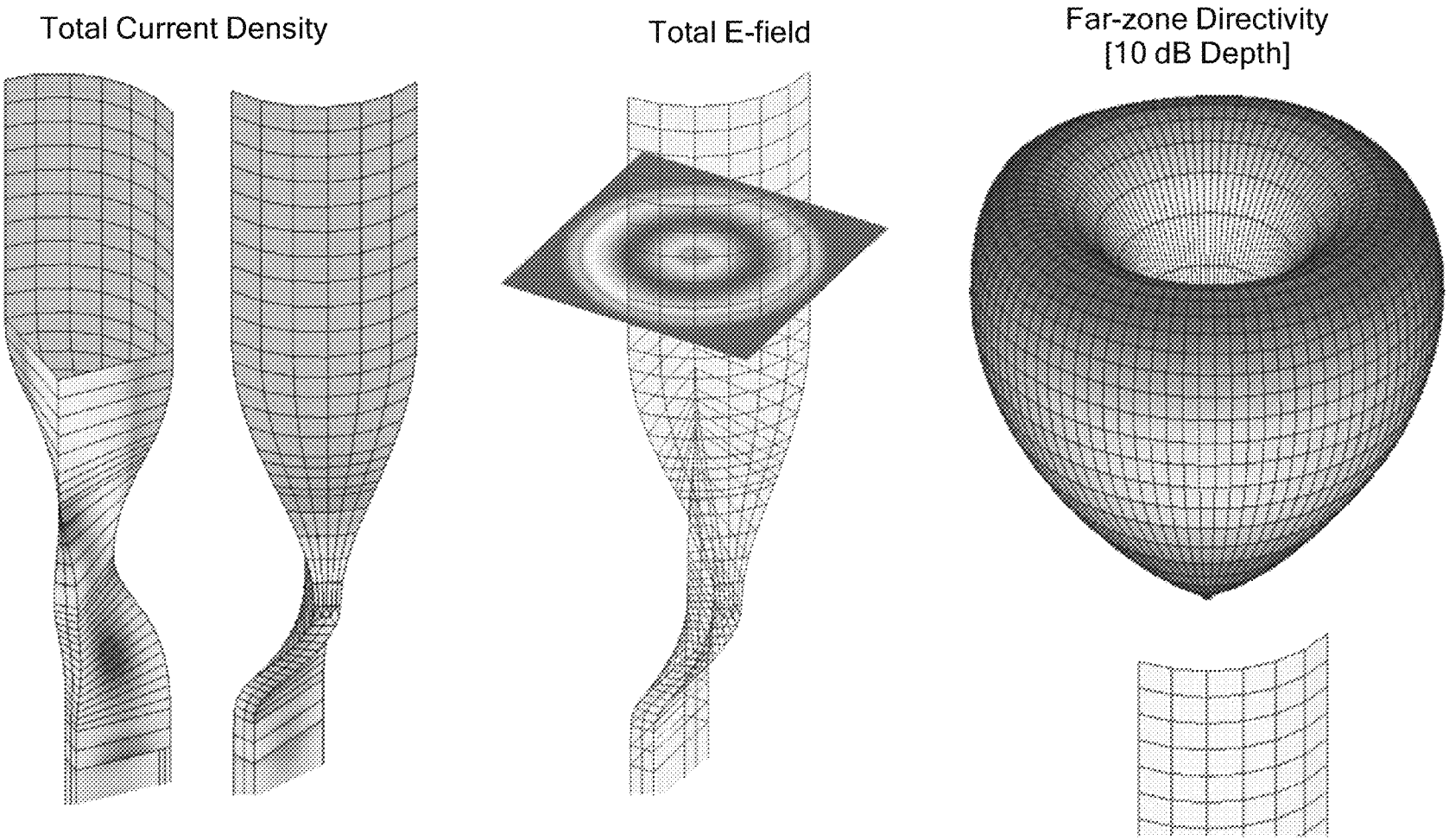
FIG. 2C visualizes the geometry and EM performance of the duo-quad converter according to the disclosure.

Design guidelines for the transitioning geometry are 1) all surfaces must have a continuous first derivative (no discontinuities) in the direction of wave propagation to minimize reflection, 2) the waveguide preserves the wave impedance of the rectangular waveguide throughout the transition to eliminate impedance mismatches that would cause reflection, and 3) the geometry-generating computer code generating the waveguide surfaces includes the capability to vary spatial transition rates to allow axial length to be optimized to minimize axial length while maintaining propagation performance. A suite of computer codes generate and visualize the waveguide combiner geometry, write input files for simulating the EM performance of the design by a commercial EM simulation code, mine simulation data files of pertinent EM data to compute figures of merit (FoMs) evaluating design performance, and visualize the results. FIG. 2C visualizes the EM performance of the duo-quad converter 100, revealing nearly uniform (non-resonant) current density throughout and very high mode purity in the $TE_{01}$ circular output mode. FIG. 2C shows a WIPL-D simulations of an optimized high-taper duo-quad wideband waveguide combiner/mode-converter 100 demonstrating excellent purity of the output $TE_{01}$ circular mode.

Figure 3:
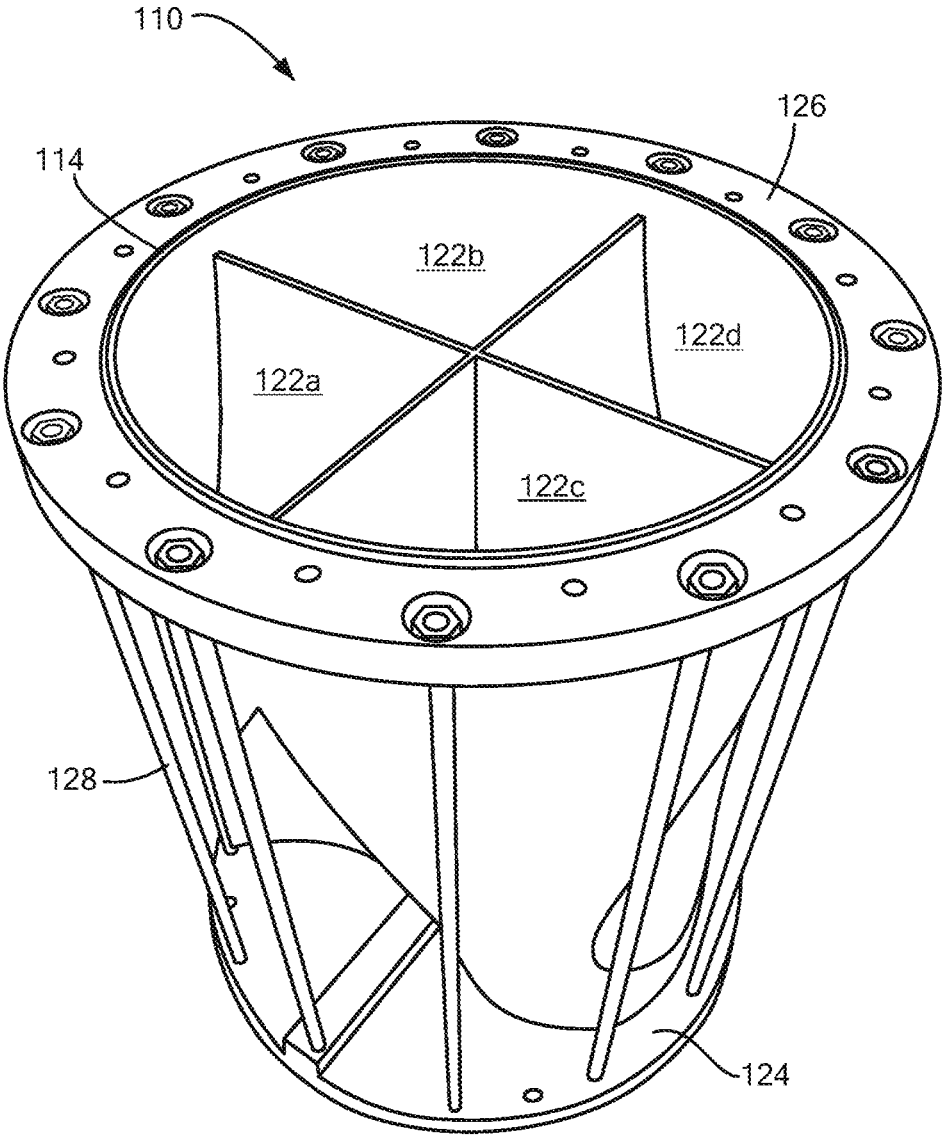
FIG. 3 shows an assembled hardware embodiment of a duo-quad wideband waveguide combiner/mode-converter.
Figure 3A:
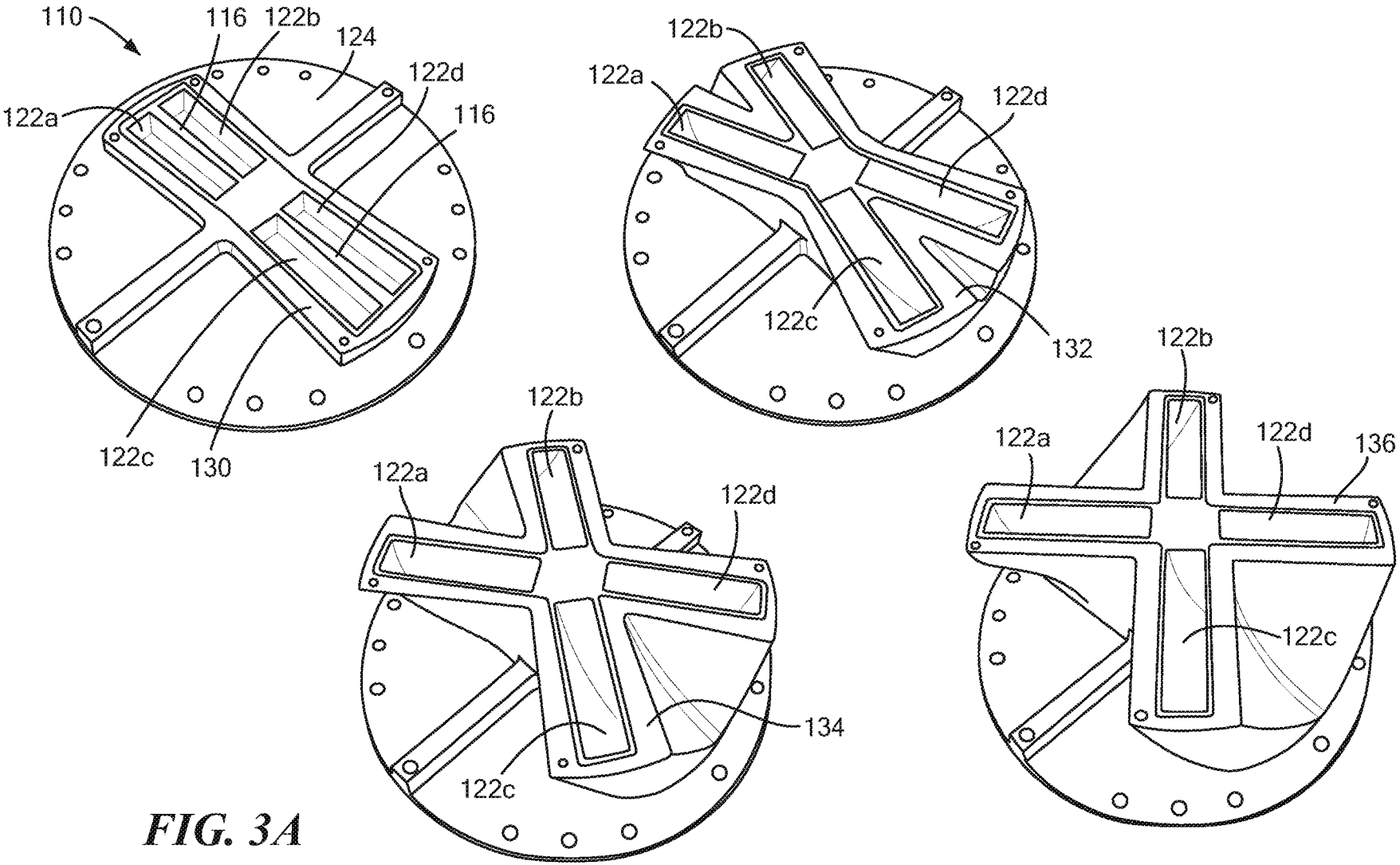
FIGS. 3A, 3B and 3C show assembly of a hardware embodiment of a duo-quad wideband waveguide combiner/mode-converter as a sequential stack of machined layers.

FIG. 3 shows a top view of an assembled hardware embodiment of a duo-quad wideband waveguide combiner/mode-converter 110 capable of being evacuated for a high-power application. As can be seen, waveguide 122*a* rotates to its own quadrant about the center axis of the circular output and transitions from a rectangular cross-section to a cross-section resembling a pie slice spanning one quadrant of the composite circular cross section of circular waveguide 114. In a similar manner, waveguide 122*b*, waveguide 122*c* and waveguide 122*d*, each rotates to its own quadrant about the center axis of the circular output and transitions from a rectangular cross-section to a cross-section resembling a pie slice spanning one quadrant of the composite circular cross section of circular waveguide 114. As to be described, the duo-quad wideband waveguide combiner/mode-converter 110 can be provided by stacking a plurality of machined layers on top of metallic plate 124 ending with metal ring 126 and held together with metal rods 128 as shown. Alternatively, the duo-quad wideband waveguide combiner/mode-converter 110 can be fabricated by any known technique.

Figure 3B:
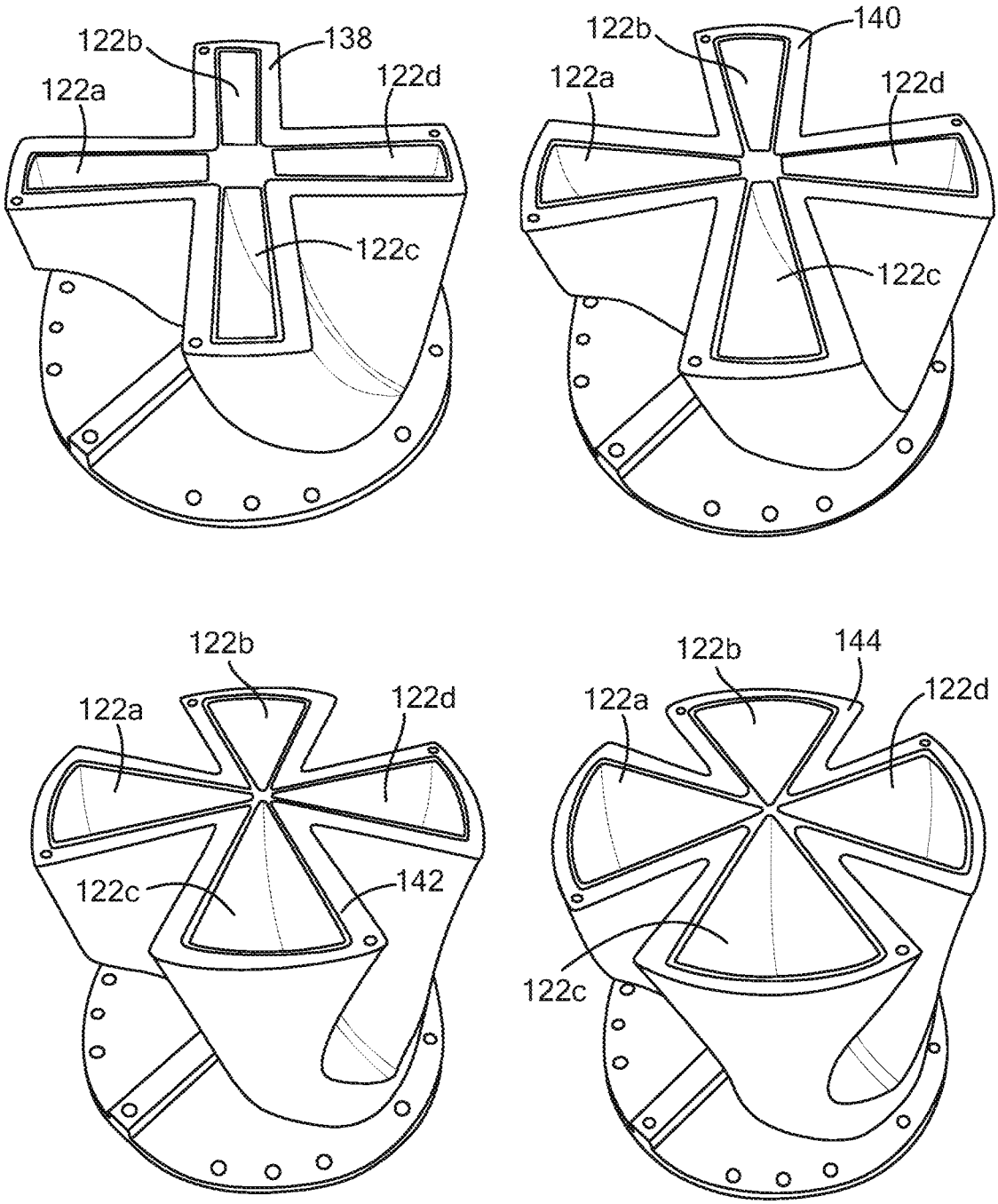
Figure 3C:
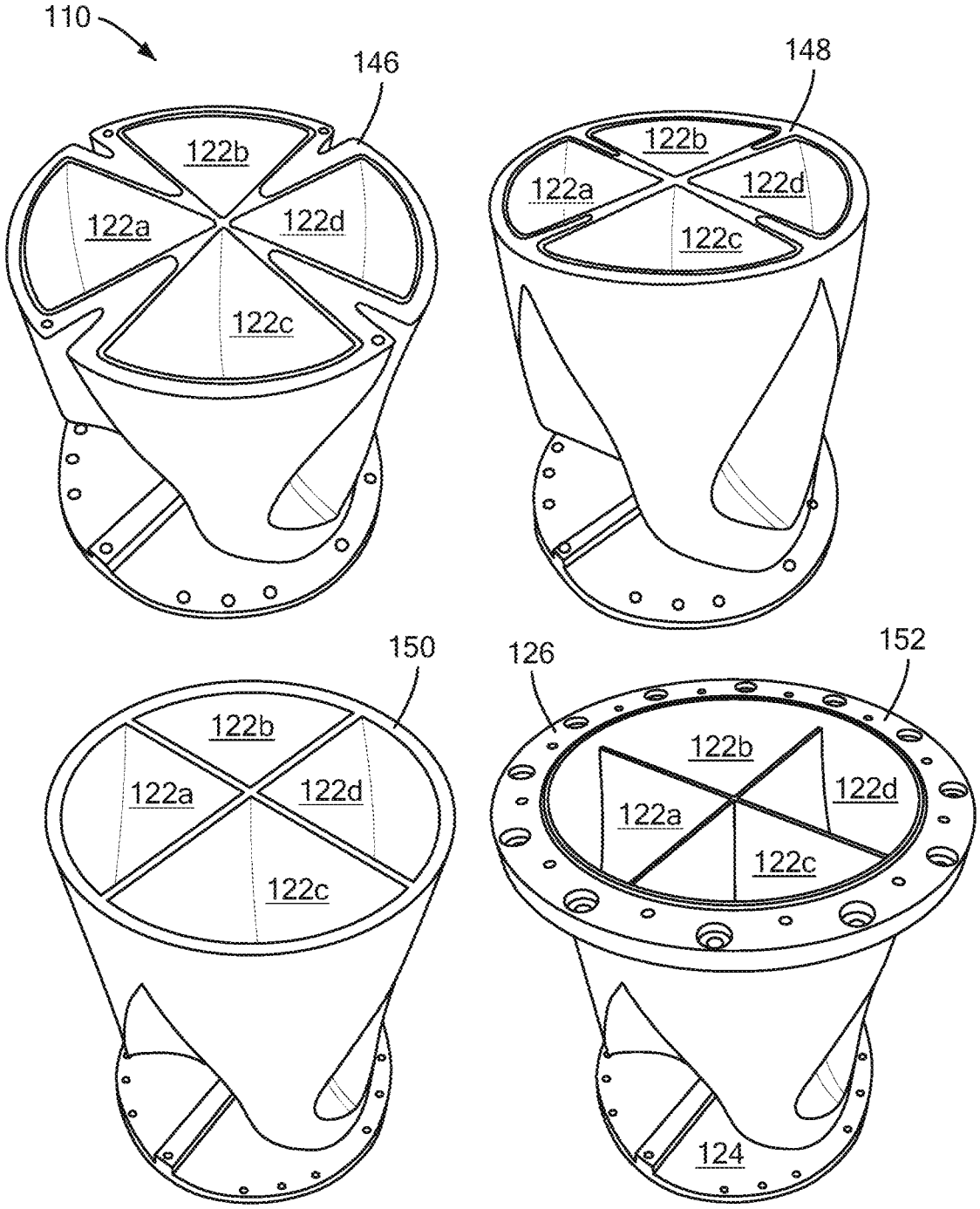

FIGS. 3A, 3B and 3C show assembly of a hardware embodiment of a duo-quad wideband waveguide combiner/mode-converter 110 as a sequential stack of machined layers capable of holding vacuum in a high-power application. Referring to the left most view of FIG. 3A, a metallic plate 124 is provided at the input of the duo-quad combiner 110 where each rectangular waveguide input is bifurcated by a thin septum 116. The septum 116 then splits each waveguide into two waveguides, hence waveguide 112*a* splits into waveguides 122*a*, 122*b* and waveguide 112*b* splits into waveguides 122*c*, 122*d*, each of which rotates to its own quadrant about the center axis of the circular output and transitions from a rectangular cross-section to a cross-section resembling a pie slice spanning one quadrant of the composite circular cross section by stacking sequential layers of metal structure to provide the required transition. Each layer is fabricated on one side to mate with the layer adjacent to it. For example, layer 132 is fabricated on one side to mate with the metallic plate 124 forming the bottom layer and on the other side to mate with layer 134. Layer 134 is fabricated to mate with layer 132 and 136. Layer 136 is fabricated to mate with layer 134 and 138. Layer 138 is fabricated to mate with layer 136 and 140. Layer 140 is fabricated to mate with layer 138 and 142. Layer 142 is fabricated to mate with layer 140 and 144. Layer 144 is fabricated to mate with layer 142 and 146. Layer 146 is fabricated to mate with layer 144 and 148. Layer 148 is fabricated to mate with layer 146 and 150. Layer 150 is fabricated to mate with layer 148 and 152 and Layer 152 is fabricated to mate with layer 150. Each layer is successively shaped with apertures (or openings) to provide the requisite transition for each of the waveguides 122*a*, 122*b*, 122*c*, and 122*d* to rotate to its own quadrant about the center axis of the circular output and transitions from a rectangular cross-section to a cross-section resembling a pie slice spanning one quadrant of the composite circular cross section as shown. It should be appreciated the number of layers used to fabricate the duo-quad wideband waveguide combiner/mode-converter 110 can vary depending on the machining capability of the fabricator. As described above, the transitioning geometry of the layers are disposed so all surfaces have a continuous first derivative (no discontinuities) in the direction of wave propagation to minimize reflection and the waveguide preserves the wave impedance of the rectangular waveguide throughout the transition to eliminate impedance mismatches that would cause reflection.

All references cited herein are hereby incorporated herein by reference in their entirety.

Having described preferred embodiments, it will now become apparent to one of ordinary skill in the art that other embodiments incorporating their concepts may be used. For example, elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

It is felt therefore that these embodiments should not be limited to disclosed embodiments, but rather should be limited only by the spirit and scope of the appended claims.

What is claimed is:

1. A duo-quad wideband wave guide combiner comprising:

a circular waveguide having a center axis with a cross section with four quadrants; and two waveguides, each waveguide being bifurcated at an input to the wave guide combiner by a thin septum to split each of the two waveguide into two bifurcated waveguides, each of the bifurcated waveguides rotating to a respective one of the four quadrants about the center axis of the circular waveguide with converging walls terminating when a composite cross section becomes circular.

2. The duo-quad wideband wave guide combiner as recited in claim 1 wherein each one of the bifurcated waveguides accommodates a $TE_{10}$ rectangular mode signal and transitions from a rectangular cross section to a cross section resembling a pie slice spanning one quadrant of the four quadrants of a composite circular cross section of the circular waveguide.

3. The duo-quad wideband wave guide combiner as recited in claim 2 comprising:

successive machined layers of metal stacked upon each other with each machined layer shaped accordingly to provide the transition from the rectangular cross section to the cross section resembling the pie slice spanning one quadrant of the four quadrants of the composite circular cross section of the circular waveguide.

4. The duo-quad wideband wave guide combiner as recited in claim 2 comprising:

successive machined layers of metal stacked upon each other with each machined layer shaped accordingly to provide the transition for each one of the bifurcated waveguides from the rectangular cross section to the cross section resembling the pie slice spanning one quadrant of the four quadrants of the composite circular cross section to provide the four quadrants of the composite circular cross section.

5. The duo-quad wideband wave guide combiner as recited in claim 2 wherein each one of the bifurcated waveguides once transitioned to a cross section resembling the pie slice spanning one quadrant of the four quadrants of the composite circular cross section to provide the composite circular cross section terminates the thin septum between adjacent pie slice cross sections.

6. A power combiner for combining radio frequency signals from two inputs into a combined output signal at an output having a $TE_{01}$ circular mode comprising:

a first rectangular waveguide having a $TE_{10}$ rectangular mode, the first rectangular waveguide having a thin septum to bifurcate the first rectangular waveguide into two bifurcated waveguides, each one of the two bifurcated waveguides of the first rectangular waveguide transitions from a rectangular cross section to a cross section resembling a pie slice spanning one quadrant of a composite circular cross section;

a second rectangular waveguide having a $TE_{10}$ rectangular mode, the second rectangular waveguide having a thin septum to bifurcate the second rectangular waveguide into two bifurcated waveguides, each one of the two bifurcated waveguides of the second rectangular waveguide transitions from a rectangular cross section to a cross section resembling a pie slice spanning one quadrant of a composite circular cross section; and a circular waveguide having $TE_{01}$ circular mode, the circular waveguide disposed at converging walls of each one of the quadrants of the composite circular cross section which form a thin septa between each one of the quadrants.

7. The power combiner as recited in claim 6 wherein each one of the thin septa terminates at the circular waveguide.

8. The power combiner as recited in claim 6 wherein each one of the bifurcated waveguides rotates to a respective quadrant to provide the pie slice spanning one quadrant of the composite circular cross section about the center axis of the circular output and transitions from a rectangular cross-section to a cross-section resembling the pie slice spanning one quadrant of the composite circular cross section of circular waveguide.

9. The power combiner as recited in claim 6 comprising successive machined layers of metal stacked upon each other with each machined layer shaped accordingly to provide the transition from a rectangular cross section to a cross section resembling the pie slice spanning one quadrant of four quadrants of the composite circular cross section.

10. The power combiner as recited in claim 9 comprising a metallic plate with the successive machined layers of metal stacked upon each other stacked on the metallic plate ending with a metal ring and held together with metal rods.

11. A method of providing a power combiner for combining two $TE_{10}$ rectangular mode microwave signals into a combined output $TE_{01}$ circular mode microwave signal comprising:

providing a metallic plate having a first rectangular opening and a second rectangular opening, each opening accommodating a rectangular waveguide as an input to the power combiner, the first rectangular opening bifurcated by a first thin septum to split the first rectangular waveguide into a first bifurcated waveguide and a second bifurcated waveguide, the second rectangular opening bifurcated by a second thin septum to split the second rectangular waveguide into a third bifurcated waveguide and a fourth bifurcated waveguide;

providing a first metallic layer having a first side and a second side with four openings, each of the four openings on the first side mating with a respective bifurcated waveguide of the first, second, third or fourth bifurcated waveguides in the metallic plate, each of the four opening partially rotates to a respective quadrant about a center axis of a circular output and transitions from a rectangular cross-section to a cross-section resembling a pie slice spanning one quadrant of a composite circular cross section of circular waveguide;

providing a second metallic layer having a first side and a second side with four openings, each of the four openings on the first side mating with a respective opening in the second side of the first metallic layer, each of the four opening partially rotates to a respective quadrant about a center axis of a circular output and transitions from a rectangular cross-section to a cross-section resembling a pie slice spanning one quadrant of a composite circular cross section of circular waveguide;

providing successive layers having a first side and a second side with four openings, each of the four openings on the first side mating with a respective opening in the second side of an adjacent metallic layer, each of the four opening partially rotates to a respective quadrant about a center axis of a circular output until a transition from a rectangular cross-section to a cross-section resembling a pie slice spanning one quadrant of a composite circular cross section of circular waveguide is completed; and providing a ring with an aperture disposed adjacent the successive layer having a completed composite circular cross section, the aperture sized to match the circular cross section in the successive layer and providing the output of the power combiner.

12. A method as recited in claim 11 wherein the providing successive layers comprises:

ensuring transitioning geometry of the layers are disposed so all surfaces have a continuous with no discontinuities in the direction of wave propagation to minimize reflection and the waveguide preserves the wave impedance of the rectangular waveguide throughout the transition.

* * * * *